US011828476B2

(12) United States Patent
Park et al.

(10) Patent No.: US 11,828,476 B2
(45) Date of Patent: Nov. 28, 2023

(54) AXIAL FAN FOR OUTDOOR UNIT OF AIR CONDITIONER

(71) Applicant: LG ELECTRONICS INC., Seoul (KR)

(72) Inventors: Keuntae Park, Seoul (KR); Inbeom Cheon, Seoul (KR); Jaehyuk Jung, Seoul (KR); Hyuneun Kwak, Seoul (KR); Seokho Choi, Seoul (KR); Siyoung Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 11 days.

(21) Appl. No.: 17/521,997

(22) Filed: Nov. 9, 2021

(65) Prior Publication Data

US 2022/0178558 A1 Jun. 9, 2022

(30) Foreign Application Priority Data

Dec. 3, 2020 (KR) ..... 10-2020-0167694

(51) Int. Cl.
*F04D 29/66* (2006.01)
*F24F 1/38* (2011.01)
*F04D 29/38* (2006.01)

(52) U.S. Cl.
CPC ..... *F24F 1/38* (2013.01); *F04D 29/384* (2013.01); *F04D 29/667* (2013.01)

(58) Field of Classification Search
CPC ..... F04D 29/384; F04D 29/386; F04D 29/667
See application file for complete search history.

(56) References Cited

U.S. PATENT DOCUMENTS

| | | | | |
|---|---|---|---|---|
| 8,007,243 | B2 | 8/2011 | Arinaga et al. | |
| 9,863,433 | B2 | 1/2018 | Tadokoro et al. | |
| 10,400,604 | B2 | 9/2019 | Sawada | |
| 11,149,742 | B2 * | 10/2021 | Honma | F24F 1/38 |
| 11,333,165 | B2 * | 5/2022 | Iwata | F04D 29/384 |
| 2014/0338388 | A1 * | 11/2014 | Kim | F04D 29/681 62/426 |
| 2015/0240645 | A1 | 8/2015 | Yokose et al. | |
| 2018/0238343 | A1 | 8/2018 | Nakashima et al. | |

(Continued)

FOREIGN PATENT DOCUMENTS

| | | |
|---|---|---|
| CN | 201739227 | 2/2011 |
| CN | 102828997 | 12/2012 |
| CN | 104487712 | 4/2015 |

(Continued)

OTHER PUBLICATIONS

Korean Office Action issued in Application No. 10-2020-0167694 dated Nov. 19, 2021.

(Continued)

*Primary Examiner* — Sabbir Hasan
(74) *Attorney, Agent, or Firm* — KED & ASSOCIATES

(57) ABSTRACT

An axial fan for an outdoor unit of an air conditioner is provided. The axial fan may include at least one blade connected to a hub. The at least one blade may include a blade inner portion, a blade outer portion provided outside of the blade inner portion in a radial direction, and a blade connector that connects the blade inner portion and the blade outer portion as a curved surface, thereby improving noise and increasing an air volume.

19 Claims, 10 Drawing Sheets

(56) References Cited

U.S. PATENT DOCUMENTS

| | | | |
|---|---|---|---|
| 2019/0048890 | A1 | 2/2019 | Honma et al. |
| 2020/0240429 | A1 | 7/2020 | Tadokoro et al. |

FOREIGN PATENT DOCUMENTS

| | | |
|---|---|---|
| CN | 107795516 | 3/2018 |
| CN | 111059076 | 4/2020 |
| CN | 111425454 | 7/2020 |
| KR | 10-2012-0007613 | 1/2012 |
| KR | 10-2018-0013514 | 2/2018 |
| KR | 10-2019-0081874 | 7/2019 |
| WO | WO 2014/050146 | 4/2014 |
| WO | WO 2017-042877 | 3/2017 |
| WO | WO 2017/154246 | 9/2017 |
| WO | WO 2018/158859 | 9/2018 |

OTHER PUBLICATIONS

Japanese Office Action dated Oct. 25, 2022 issued in Application No. 2021-196340.
Korean Notice of Allowance dated May 3, 2022 issued in Application No. 10-2020-0167694.
European Search Report dated Apr. 19, 2022 issued in Application No. 21208705.0.
Chinese Office Action dated Apr. 26, 2023 issued in Application No. 202111323781.4.
Australian Office Action dated Mar. 21, 2023 issued in Application No. 2021277760.

* cited by examiner

AXIAL FAN FOR OUTDOOR UNIT OF AIR CONDITIONER

CROSS-REFERENCE TO RELATED APPLICATION(S)

The present application claims priority under 35 U.S.C. 119 and 35 U.S.C. 365 to Korean Patent Application No. 10-2020-0167694, filed in Korea on Dec. 3, 2020, which is hereby incorporated by reference in its entirety.

BACKGROUND

1. Field

An axial fan for an outdoor unit of an air conditioner is disclosed herein.

2. Background

In general, an air conditioner is an apparatus that cools or heats an indoor space. The air conditioner includes a compressor that compresses refrigerant, a condenser that condenses the refrigerant discharged from the compressor, an expander that expands the refrigerant which has passed through the condenser, and an evaporator that evaporates the refrigerant expanded by the expander.

The condenser and evaporator of the air conditioner are heat exchangers that exchange outside air with the refrigerant and are provided in an indoor unit or an outdoor unit. The heat exchanger provided in the indoor unit is referred to as an indoor heat exchanger and the heat exchanger provided in the outdoor unit is referred to as an outdoor heat exchanger.

In this case, an axial fan that blows air toward the heat exchanger may be disposed at one side of the heat exchanger provided in the outdoor unit. The axial fan includes a hub connected to a rotational shaft of a motor and a plurality of blades coupled to an outside of the hub. When the axial fan is rotated by driving the motor, a pressure difference is generated at front/rear surfaces of the plurality of blades and a suction force for blowing air is generated due to the pressure difference.

According to a conventional axial fan, as an inner blade group and an outer blade group are separately manufactured and are coupled to a middle ring, rigidity at a coupling portion is weakened. Therefore, air volume may be reduced and noise generated at the coupling portion.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the drawings. However, embodiments are not limited to the embodiments disclosed and those skilled in the art who understand the spirit of the embodiments will be able to easily propose other embodiments within the scope of the same spirit.

Figure 1:
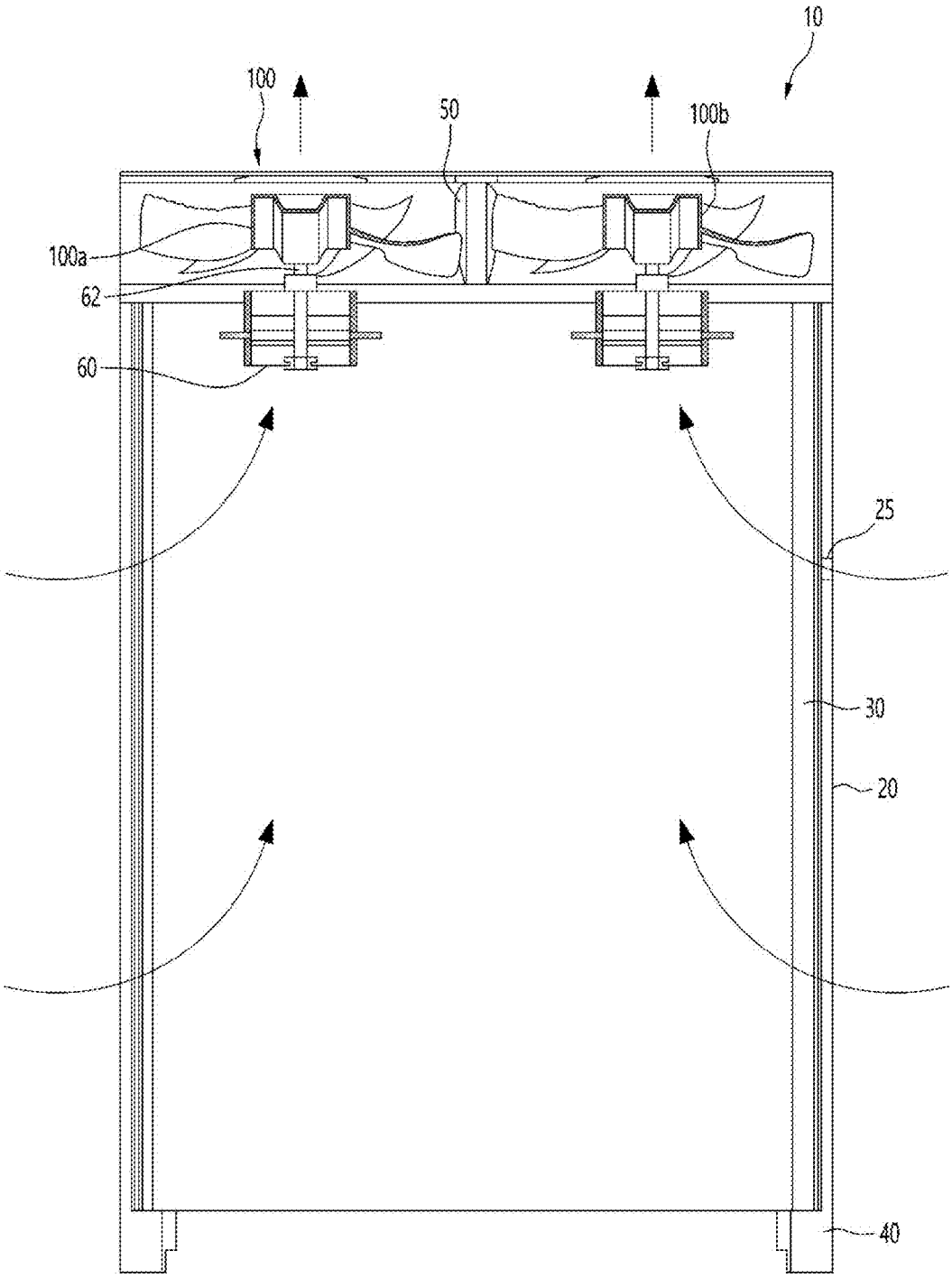
FIG. 1 is a cross-sectional view of an outdoor unit of an air conditioner according to an embodiment.
Figure 2:
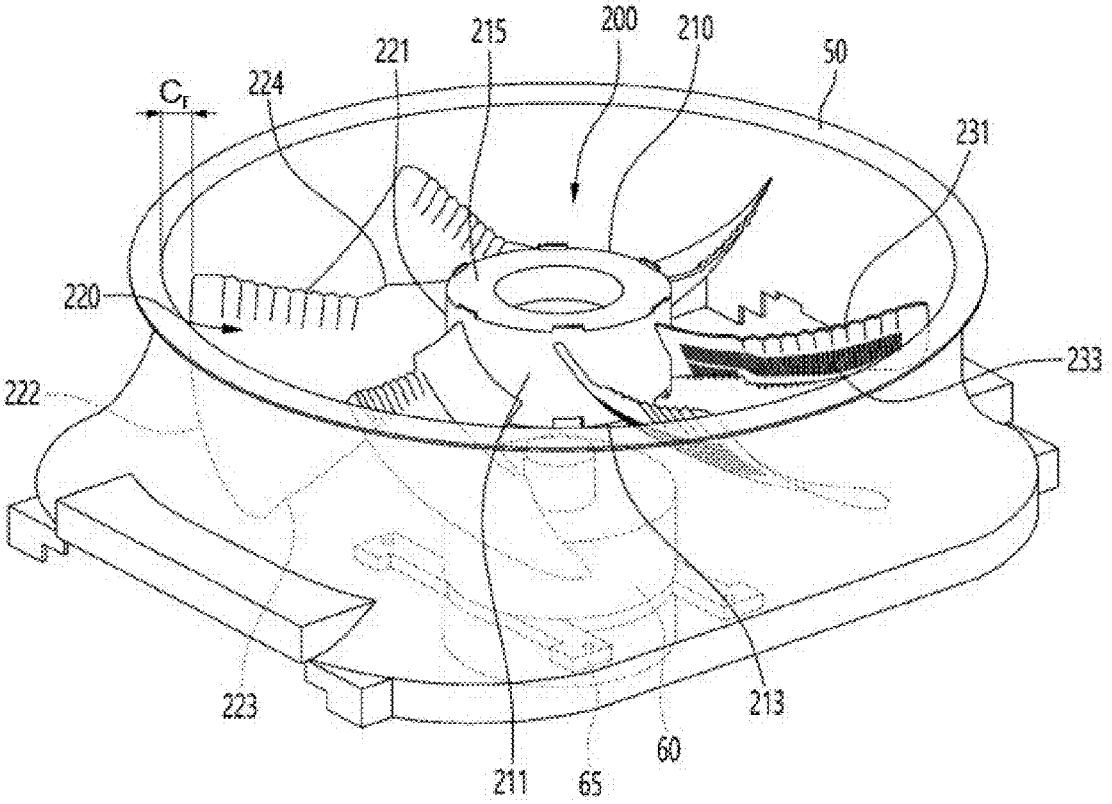
FIG. 2 is a perspective view of a fan assembly and an orifice according to an embodiment.

FIG. 1 is a cross-sectional view of an outdoor unit of an air conditioner according to an embodiment. FIG. 2 is a perspective view of a fan assembly and an orifice according to an embodiment.

Referring to FIGS. 1 and 2, an outdoor unit 10 of an air conditioner according to an embodiment may include a case 20 forming a suction unit 25 for introducing outside air and a heat exchanger 30 provided inside of the case 20 to exchange heat with outside air. The heat exchanger 30 may be disposed adjacent to an inner surface of the case 20. The case 20 may have a polyhedral shape, and the heat exchanger 30 may have a bent shape corresponding with the shape of the case 20.

A lower portion of the case 20 may be provided with legs 40 that support the outdoor unit 10 on the ground.

The outdoor unit 10 may include fan assembly 100 supported on an upper portion of the case 20 to cause outside air to flow. A plurality of the fan assembly 100 may be provided. The plurality of fan assemblies 100 may include first and second fan assemblies 100*a* and 100*b* arranged side by side in a horizontal direction.

The outdoor unit 10 may further include an orifice 50 forming a flow passage of air passing through the plurality of fan assemblies 100. The orifice 50 may penetrate vertically, and air may be introduced through a lower portion of the orifice 50 and discharged upward. An axial fan 200 may be disposed inside of the orifice 50.

The orifice 50 may have a shape in which an area of the flow passage decreases upward from a lower end thereof and then increases. A plurality of the orifice 50 may be provided, and an axial fan of the first fan assembly 100*a* and an axial fan of the second fan assembly 100*b* may be provided inside of each orifice 50.

The fan assembly 100 may include the axial fan 200. A gap $C_r$ may be formed between an outermost portion of the axial fan 200 and an inner surface of the orifice 50. The gap $C_r$ may be designed to have an appropriate value such that air flow does not leak while preventing rotational interference with the axial fan 200.

The fan assembly 100 may further include a fan motor 60 that rotates the axial fan 200. The fan motor 60 may be axially connected to a lower side of the axial fan 200. More specifically, a rotational shaft 62 may extend to an upper side of the fan motor 60, and the rotational shaft 62 may be coupled to a hub 210 of the axial fan 200.

A motor bracket 65 may be provided outside of the fan motor 60/The motor bracket 65 may be supported on the case 20 or peripheral components of the case 20.

When the fan motor 60 is driven, the axial fan 200 rotates and outside air may be suctioned into the outdoor unit 10 through the suction unit 25 by suction force of the axial fan 200. The outside air may pass through the heat exchanger 30, flow upward, and pass through the axial fan 200. Outside air which has passed through the axial fan 200 may be discharged through an upper side of the outdoor unit 10.

Figure 3:
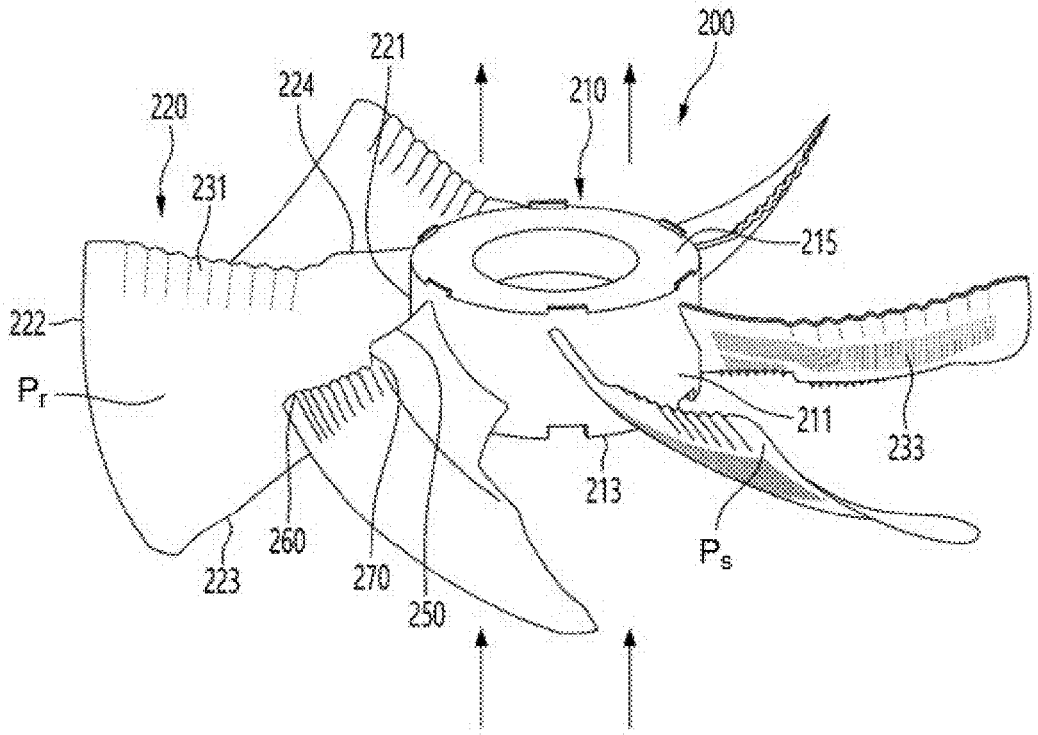
FIG. 3 is a perspective view of an axial fan in a pressure surface direction according to an embodiment.
Figure 4:
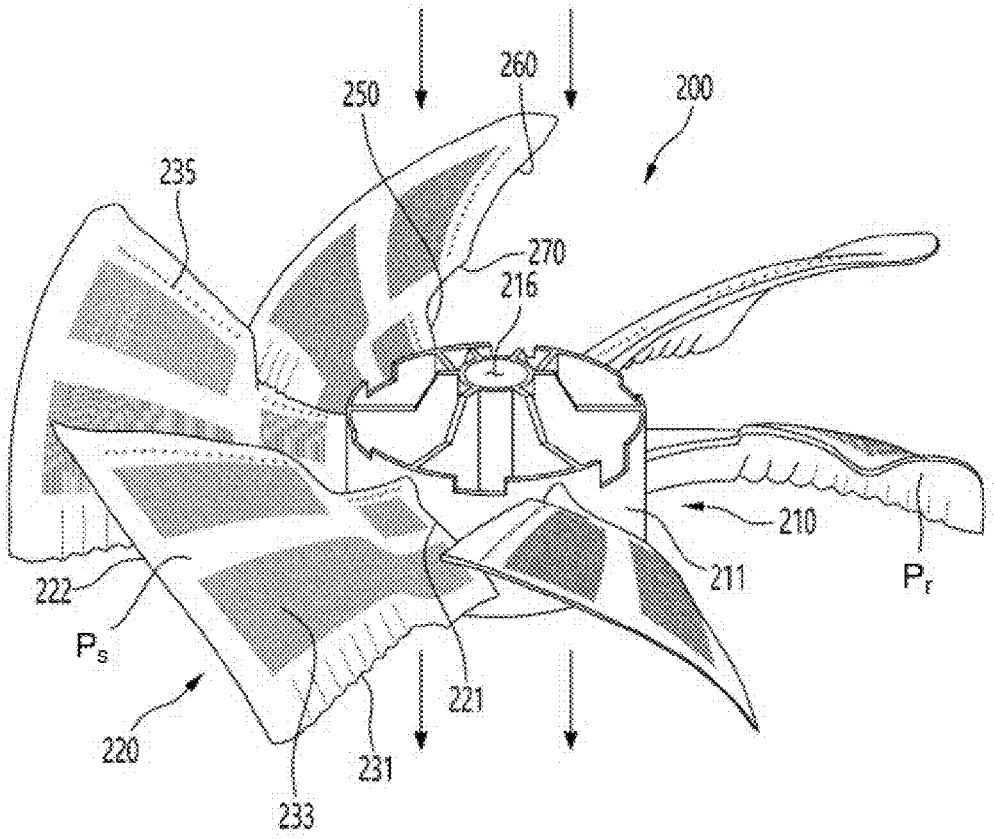
FIG. 4 is a perspective view of an axial fan in a suction surface direction according to an embodiment.
Figure 5:
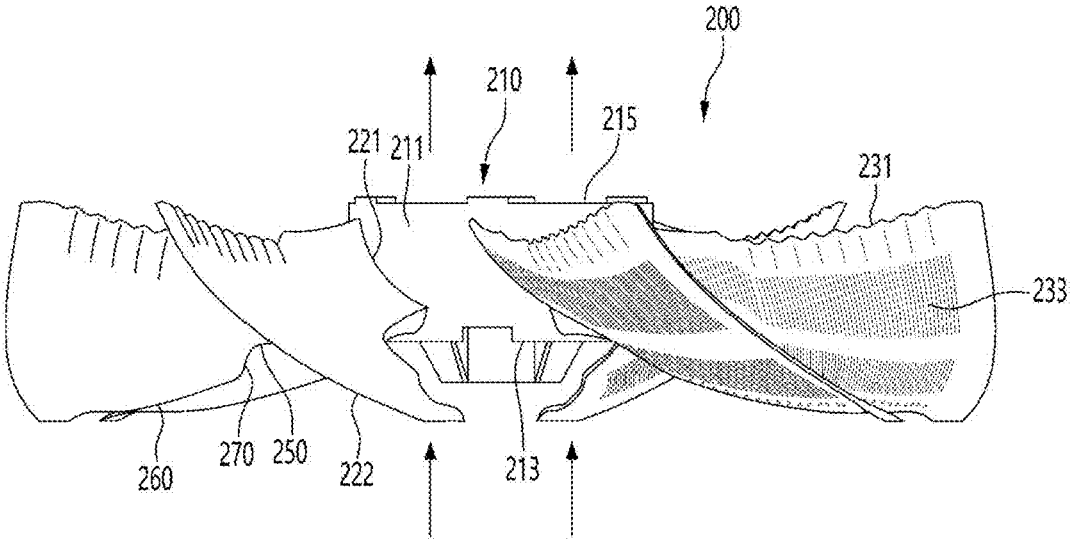
FIG. 5 is a side view of an axial fan according to an embodiment.

FIG. 3 is a perspective view of an axial fan in a pressure surface direction according to an embodiment. FIG. 4 is a perspective view of an axial fan in a suction surface direction according to an embodiment. FIG. 5 is a side view of an axial fan according to an embodiment.

Referring to FIGS. 2 to 5, the axial fan 200 according to this embodiment may include the hub 210 coupled with the rotational shaft 62 of the fan motor 60 and a plurality of blades 220 coupled to an outer circumferential surface of the hub 210. The rotational shaft 62 may extend upward from the fan motor 60 to be coupled to a center of the hub 210.

The hub 210 may have a substantially cylindrical shape. More specifically, the hub 210 may include a hub outer circumferential surface 211 coupled with the plurality of blades 220, a hub suction surface 213 that forms an air suction side and a hub discharge surface 215 forming an air discharge side.

From another point of view, it may be understood that the hub suction surface 213 forms a "front surface" of the hub 210, and the hub discharge surface 215 forms a "rear surface" of the hub discharge surface 215. Hereinafter, an air suction direction of the axial fan 200 is defined as a "front portion" and an air discharge direction thereof is defined as a "rear portion" based on the axial fan 200.

The hub 210 may form an axial insertion portion 216 into which the rotational shaft 62 is inserted. The axial insertion portion 216 may be recessed from the hub suction surface 213.

Six blades 220 may be, for example, disposed on the outer circumferential surface of the hub 210 spaced apart in a circumferential direction. Each blade 220 may include a hub connector 221 coupled to the hub outer circumferential surface 211 and a tip 222 that forms an end of the blade 220. The hub connector 221 forms an inner end of the blade 220 in a radial direction and the tip 222 forms an outer end of the blade 220.

The hub connector 221 may extend from the hub suction surface 213 toward the hub discharge surface 215 in an inclined direction. The inclined direction may be understood as extending obliquely with respect to the hub suction surface 213, that is, an inclined angle in the form of an acute angle.

When the tips 222 of the plurality of blades 220 are connected to extend in the circumferential direction, a virtual circle/path $T_1$ (see FIG. 6) may be formed. A distance from the center of the hub 210 or the rotational shaft 62 to the virtual circle $T_1$ may be defined as a radius of the axial fan 200.

The blade 220 may include a leading edge 223 that forms a front end in a rotational direction and a trailing edge 224 that forms a rear end in the rotational direction. In FIG. 3, when the axial fan 200 is viewed from the top, the axial fan 200 may rotate counterclockwise.

The blade 220 may include a suction surface $P_s$ facing in a direction in which air is blown and a pressure surface $P_r$ facing a direction in which air is discharged. The suction surface $P_s$ may be understood as a surface that faces the front and through which air is introduced, and the pressure surface $P_r$ may be understood as a surface that faces the rear and is opposite to the suction surface $P_s$.

The blade 220 may further include a wrinkle portion 231. The wrinkle portion 231 may be formed in the trailing edge 224 of the blade 220.

The wrinkle portion 231 may be provided on a blade outer portion 260. The wrinkle portion 231 may be configured such that a plurality of depressions and a plurality of protrusions are alternately disposed. More specifically, the wrinkle portion 231 may include a plurality of depressions depressed in a direction facing the suction surface $P_s$ of the blade 220 and a plurality of protrusions that protrudes in a direction facing the pressure surface $P_r$ of the blade 220. According to the configuration of the wrinkle portion 231, by repeatedly changing a height of the trailing edge 224 of the blade 220, it is possible to generate a phase difference in air flowing on a surface of the blade 220, thereby reducing noise generated by the blade 220.

The blade 220 may further include an uneven portion 233. The uneven portion 233 may be formed in or on at least one of the suction surface $P_s$ or the pressure surface $P_r$ of the blade 220. For example, the uneven portion 233 may be provided in or on the suction surface $P_s$ of the blade 220, as shown in the drawings.

The uneven portion 233 may include ribs that protrude in the circumferential direction or grooves recessed in the circumferential direction. A plurality of ribs or grooves may be spaced apart from each other at a predetermined interval.

When the axial fan 200 rotates, an airflow may be generated in the axial direction due to a pressure difference between the suction surface $P_s$ and the pressure surface $P_r$. In this case, air flow in a radial direction of the blade 220, that is, along the surface of the blade 220 from the hub 210 toward the tip 222, is formed by centrifugal force, thereby reducing performance of the axial fan 200. In particular, this phenomenon may be generated more on the suction surface $P_s$ having relatively lower pressure than on the pressure surface $P_r$. In this embodiment, the suction surface $P_s$ of the blade 220 is provided with the uneven portion 233, thereby limiting flow in the radial direction of the blade 220.

The blade 220 may further include at least one protrusion 235. The at least one protrusion 235 may be provided on the suction surface $P_s$ of the blade 220.

A plurality of the protrusion 235 may be provided and arranged to be spaced apart from each other in the radial direction of the blade 220. The plurality of protrusions 235 may be disposed at positions adjacent to the leading edge 223 of the blade 220.

When the axial fan 200 rotates, air flows from the leading edge 223 to the trailing edge 224 and air flowing along the suction surface $P_s$ moves away from the suction surface $P_s$ near the trailing edge 224. In this case, a flow separation phenomenon may occur at the trailing edge 224 of the suction surface $P_s$.

In this embodiment, in order to prevent the flow separation phenomenon, the at least one protrusion 235 may be provided at a position adjacent to the leading edge 223 of the suction surface $P_s$. Turbulence is generated near the leading edge 223 of the suction surface $P_s$ by the at least one protrusion 235, and the phenomenon that flow is separated near the trailing edge 224 of the suction surface $P_s$ may be prevented by the turbulence.

When the axial fan 200 rotates, a flow rate of introduced air may be formed differently in the radial direction of the blade 220 from the hub connector 221 connected to the hub 210 to the tip 222. This is because, when the axial fan 200 is used in the outdoor unit 10, a phenomenon that the air flow is disturbed by a mounting structure of the fan motor 60 may occur. For example, the flow rate of air introduced through an outer portion of the blade 220 close to the tip 222 may be larger than that of air introduced through an inner portion of the blade 220 close to the hub connector 221 in the radial direction. At the tip 222 of the blade 220, tip leakage flow may occur in a gap $C_r$ with the orifice 50.

By such phenomena, in the blade 220, a difference may occur in the behavior of the flow of air introduced from the hub connector 221 to the tip 222. In particular, there may be a high possibility of generating noise in the outer portion of the blade having a relatively large air volume.

In consideration of this, the blade 200 according to this embodiment may be designed to be divided into a blade inner portion 250 including the hub connector 221, a blade outer portion 260 including the tip 222, and a blade connector 270 connecting the blade inner portion 250 and the blade outer portion 260 in the radial direction. For example, the blade inner portion 250 and the blade outer portion 260 may be designed by separate molds. The blade 220 may be bent or curved at least two times in the radial direction by the blade inner portion 250, the blade connector 270, and the blade outer portion 260.

Hereinafter, the blade according to an embodiments will be described with reference to the drawings.

Figure 6:
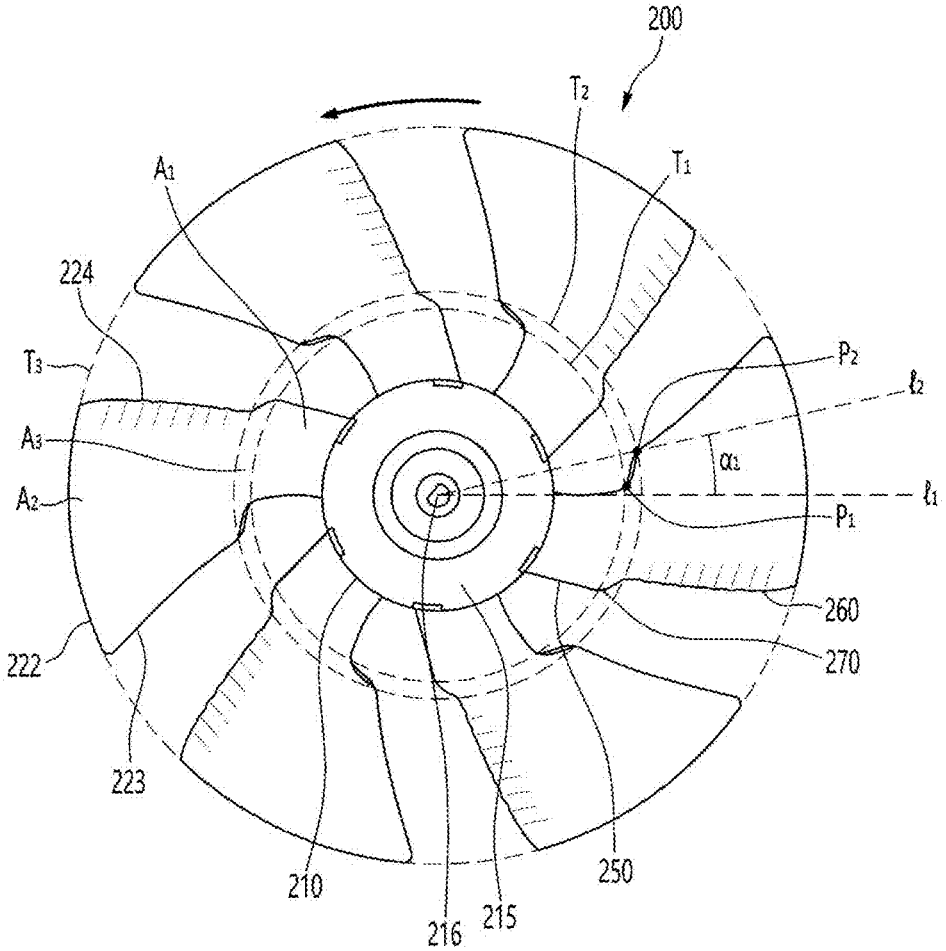
FIG. 6 is a rear view of an axial fan according to an embodiment.
Figure 7:
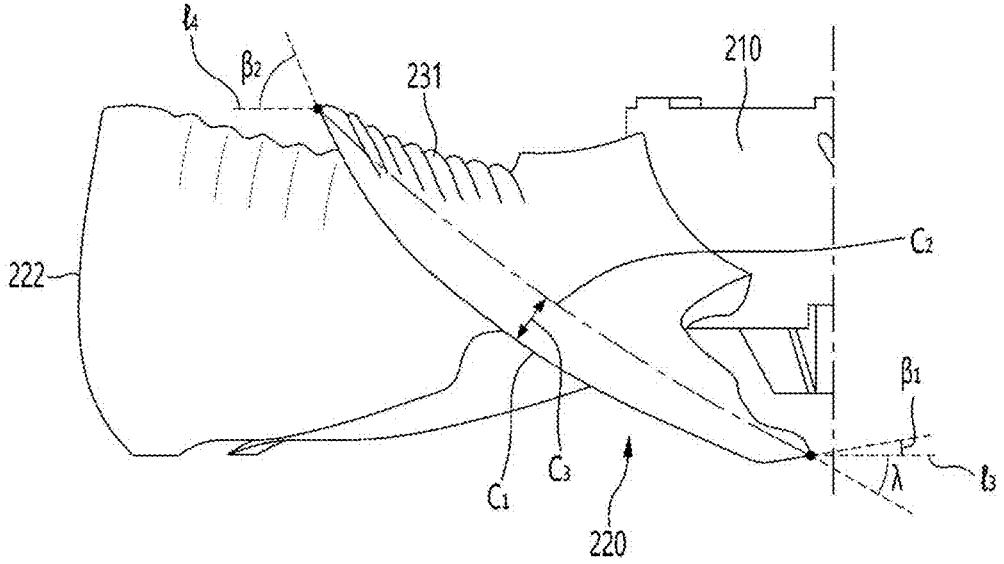
FIG. 7 is a side view showing a partial configuration of an axial fan according to an embodiment.
Figure 8:
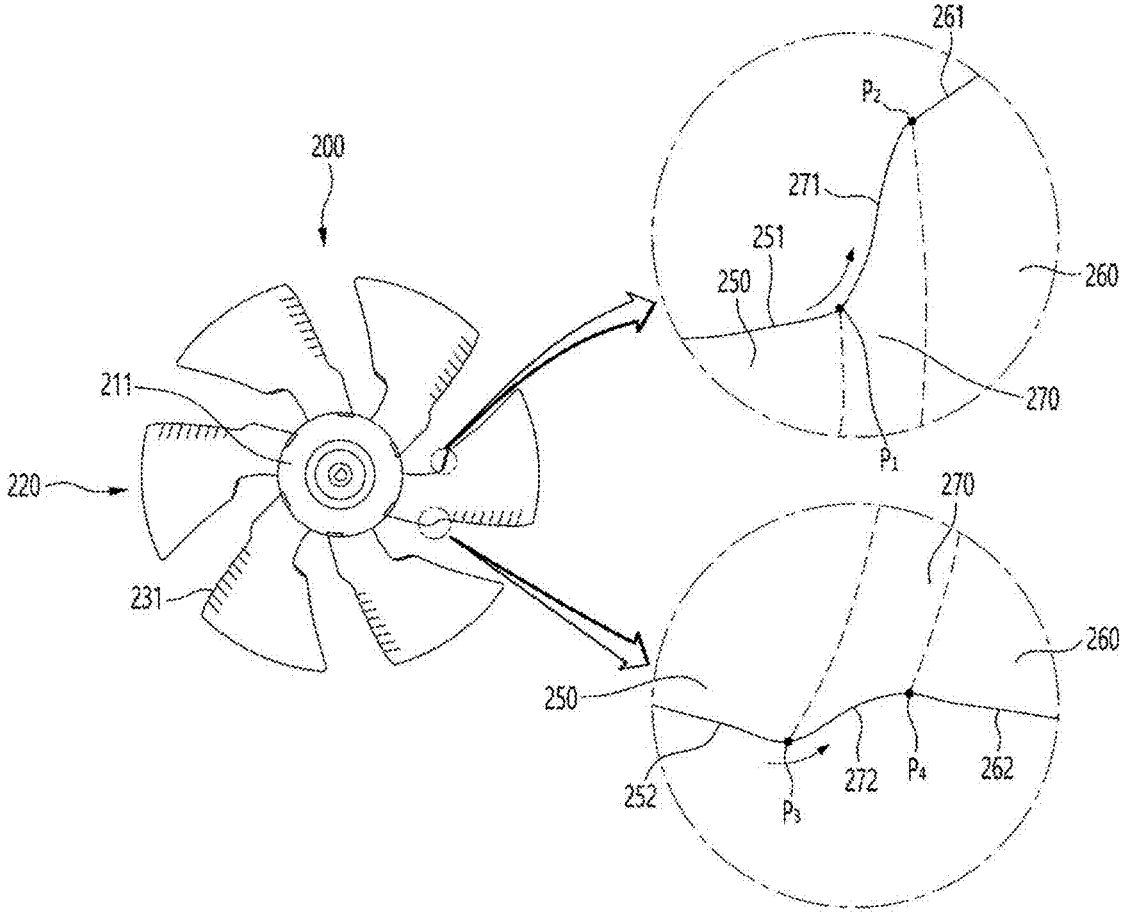
FIG. 8 is a view showing a blade inner portion, a blade connector, and a blade outer portion of an axial fan according to an embodiment.

FIG. 6 is a rear view of an axial fan according to an embodiment. FIG. 7 is a side view showing a partial configuration of an axial fan according to an embodiment. FIG. 8 is a view showing a blade inner portion, a blade connector, and a blade outer portion of an axial fan according to an embodiment.

Referring to FIGS. 6 to 8, blade 220 according to this embodiment may have a pitch angle λ, an entrance angle $\beta_1$, an exit angle $\beta_2$, a maximum camber position $\ell c$, a maximum camber amount $C_3$. and solidity $S_o$. In FIG. 6, the axial fan 200 may rotate counterclockwise.

The pitch angle A may represent an angle between a rotational direction extension line $\ell_3$ of the axial fan 200 and a straight line connecting the leading edge 223 and trailing edge of the blade 200, that is, a cord $C_2$. The entrance angle $\beta_1$ may represent an angle between a camber $C_1$ indicating a center line of a cross section of the blade 220 and the rotational direction extension line $\ell_3$ of the axial fan 220 at the leading edge 223 of the blade 220.

The exit angle $\beta_2$ may represent an angle between the camber $C_1$ and a rotational direction extension line $\ell_4$ of the axial fan 200 at the trailing edge 224 of the blade 220. The rotational direction extension line $\ell_4$ may be understood as an extension line moved in parallel from the rotational direction extension line $\ell_3$ of the axial fan 200 toward the trailing edge 224.

A distance between the camber $C_1$ and the cord $C_2$ may be defined as a camber amount, and a maximum camber position $\ell_c$ and a maximum camber amount $C_3$ from the leading edge 223 may be defined as at a point at which the camber amount is maximized.

The solidity $S_o$ may be defined as a ratio of a total area of the blade 220 to a total area of the axial fan 200. The total area of the axial fan 200 may be understood as an annular area obtained by subtracting an area of the hub 210 from an inner area of virtual circle/path $T_3$ (a path extending along the tips of the blades in the circumferential direction) of FIG. 6.

The blade 220 may extend from the hub connector 221 to the tip 222 in the radial direction, and may be configured to change area in the radial direction. For example, the area may increase in the radial direction from the hub connector 221 to the tip 222.

The blade 220 may include the blade inner portion 250 having the hub connector 221, the blade outer portion 260 having the tip 222, and the blade connector 260 that connects the blade inner portion 250 and the blade outer portion 260 in a rounded shape. The blade inner portion 250, the blade connector 270, and the blade outer portion 260 may extend in a direction from the hub connector 221 of the blade 220 to the tip 222, that is, in an outer radial direction.

An end of the blade inner portion 250 may form the hub connector 221. Based on one blade 220, the blade inner portion 250 may have a cross-sectional area of $A_1$. The cross-sectional area $A_1$ of the blade inner portion 250 may be less than a cross-sectional area $A_2$ of the blade outer portion 260. The blade inner portion 250 may be configured to increase the cross-sectional area in the outer radial direction.

A virtual circle/path extending along an outermost end of the blade inner portion 250 in the circumferential direction may be first virtual circle/path $T_1$. The blade connector 270 may extend from the blade inner portion 250 in the outer radial direction. The first virtual circle/path $T_1$ may form an innermost end of the blade connector 270. That is, a virtual circle/path extending along the innermost end of the blade connector 270 in the circumferential direction may coincide with the first virtual circle/path $T_1$. The cross-sectional area $A_3$ of the blade connector 270 may be less than a cross-sectional area $A_1$ of the blade inner portion 250.

The blade connector 270 may bent or curved from the blade inner portion 250. That is, the blade inner portion 250 and the blade connector 270 may have a shape in which the blade 220 is bent once.

The blade inner portion 250 and the blade connector 270 may have a bent shape, at the leading edge 223 and the trailing edge 224 of the blade 220, respectively.

A virtual circle/path extending along an outermost end of the blade connector 270 in the circumferential direction may be a second virtual circle/path $T_2$. The second path $T_2$ may be greater than the first virtual circle/path $T_1$, and the first virtual circle/path $T_1$ may be located inside of the second virtual circle/path $T_2$.

The blade outer portion 260 may extend from the blade connector 270 in the outer radial direction. The second virtual circle/path $T_2$ may form an innermost end of the blade outer portion 260. That is, a virtual circle/path extending along the innermost end of the blade outer portion 260 in the circumferential direction may coincide with the second virtual circle/path $T_2$.

The cross-sectional area $A_2$ of the blade outer portion 270 may be greater than the cross-sectional area $A_1$ of the blade inner portion 250. The blade outer portion 260 may be bent or curved from the blade connector 270. That is, the blade connector 270 and the blade outer portion 260 may have a shape in which the blade 220 is bent once.

The blade connector 270 and the blade outer portion 260 may have a bent shape, at the leading edge 223 and trailing edge 224 of the blade 220, respectively.

A path extending an outermost end of the blade outer portion 260 in the circumferential direction may be a third virtual circle/path $T_3$. The virtual circle/third path $T_3$ may be greater than the second virtual circle/path $T_2$, and the second virtual circle/path $T_2$ may be located inside of the third virtual circle/path $T_3$.

Based on the radial direction of the blade 220, the blade 220 may be bent or curved at least twice.

At the leading edge 223 of the blade 220, the blade inner portion 250 may be bent once in a first direction toward the blade connector 270 and bent once in a second direction at a point at which the blade connector 270 and the blade outer portion 260 are connected. The first direction and the second direction may be different.

The first direction may be a direction from the pressure surface $P_r$ of the blade toward the suction surface, that, a direction toward a front side of the axial fan 200. The second direction may be a direction from the suction surface $P_s$ of the blade toward the pressure surface $P_r$, that is, a direction toward a rear side of the axial fan 200.

More specifically, an inner leading portion 251 forming the blade inner portion 250 of the leading edge 223 may meet the blade connector 270 at a first point $P_1$. At the first point $P_1$, the blade connector 270 may be curved toward the front side of the axial fan 200. That is, a connection leading edge 271 forming the blade connector 270 of the leading edge 223 may smoothly extend forward while forming a curved surface from the inner leading edge 251.

The connection leading edge 271 may meet an outer leading edge 261 forming a front edge of the blade outer portion 260 at a second point $P_2$. At the second point $P_2$, the blade outer portion 260 may be curved toward the rear side of the axial fan 200. That is, the outer leading edge 261 may smoothly extend backward while forming a curved surface from the connection leading edge 271.

At the trailing edge 224 of the blade, the blade 220 may be bent once in a third direction at a point at which the blade inner portion 250 and the blade connector 270 are connected and bent once in a fourth direction at a point at which the blade connector 270 and the blade outer portion 260 are connected. The third direction and the fourth direction may be different.

The third direction may be a direction from the suction surface $P_s$ of the blade toward the pressure surface $P_r$, that is, a direction toward the rear side of the axial fan 200. The fourth direction may be a direction from the pressure surface $P_r$ of the blade to the suction surface $P_s$, that is, a direction toward the front side of the axial fan 200.

More specifically, the inner trailing edge 252 forming the blade inner portion 250 of the trailing edge 224 may meet the blade connector 270 at a third point $P_3$. At the third point $P_3$, the blade connector 270 may be curved toward the rear side of the axial fan 200. That is, a connection trailing edge 272 forming the blade connector 270 of the trailing edge 224 may smoothly extend backward while forming the curved surface from the inner trailing edge 252. The connection trailing edge 272 may meet an outer trailing edge forming the trailing edge of the blade outer portion 260 at a fourth point $P_4$.

A portion extending from the first point $P_1$ to the third point $P_3$ in the circumferential direction may form an "inner end" of the blade connector 270 bent from the blade inner portion 250. A portion extending from the second point $P_2$ to the fourth point $P_4$ in the circumferential direction may form an "outer end" of the blade connector 270 bent toward the blade outer portion 260. At the fourth point $P_4$, the blade outer portion 260 may be curved to the front side of the axial fan 200. That is, the outer trailing edge 261 may smoothly extend forward while forming a curved surface from the connection trailing edge 272.

In order to obtain a noise reduction effect in the axial fan 200, the blade connector 270 and the blade outer portion 260 may be configured to have a phase difference in the circumferential direction. More specifically, a first connection line $\ell_1$ connecting a center of the axial fan 200, that is, a center of the hub 210, and a radially outermost portion of the leading edge 223 of the blade inner portion 250 may be defined.

The center of the axial fan 200 may be the center of the hub 210, and the center of the hub 210 may form a center of the axial insertion portion 216. In addition, the outermost portion of the leading edge 223 of the blade inner portion 250 may form the innermost portion of the leading edge 223 of the blade connector 270.

A second connection line $\ell_2$ connecting the center of the axial fan 200 and a radially innermost portion of the leading edge 223 of the blade outer portion 260 may be defined. The first connection line $\ell_1$ and the second connection line $\ell_2$ may not coincide.

The first connection line $\ell_1$ and the second connection line $\ell_2$ may be formed to have a phase difference $\alpha_1$ in the circumferential direction. For example, in FIG. 6, the second connection line $\ell_2$ may be understood as a line obtained by rotating the first connection line $\ell_1$ counterclockwise by the phase difference with respect to the center of the axial fan 200.

The phase difference may have a value greater than 0° and equal to or less than 4°. By the phase difference, noise generated by the blade inner portion 250 and the blade outer portion 260 may be canceled.

The blade connector 270 may be configured to smoothly and continuously connect the surface of the blade 220 from the blade inner portion 250 to the blade outer portion 260. The blade connector 270 may be defined as a Bezier curve.

The blade connector 270 may be located in a range of dimensionless radius from 0.3 to 0.4, and the blade inner portion 250 may be located in a region having a dimensionless radius less than 0.3. In addition, the blade outer portion 260 may be located in a region having a dimensionless radius greater than 0.4.

The dimensionless radius $r_s$ may be defined as a value obtained by dividing a value obtained by subtracting the radius $r_{hub}$ of the hub 210 from the radius r of a corresponding portion centered on the rotational shaft 62 of the axial fan 220 by a distance $r_{tip}-r_{hub}$ from the tip of the blade 220 to the hub 210 (see the following equation).

$$r_s=(r-r_{hub})/(r_{tip}-r_{hub})$$

The blade inner portion 250 and the blade outer portion 260 may have different shapes and positions.

The blade connector 270 connecting the blade inner portion 250 and the blade outer portion 260 may have a shape continuously formed with curved surfaces respectively in contact with the leading edge 223 and trailing edge 224 of the blade inner portion 250 and the blade outer portion 260. The blade 220 may be configured to increase the area of the blade outer portion 260, in order to improve blowing ability in the blade outer portion 260.

The blade 220 may be configured such that the maximum camber position $\ell_c$ of the blade outer portion 260 is closer to the trailing edge 224 than the leading edge 223 of the blade 220. Based on the leading edge 223 of the blade 220, the maximum camber position $\ell_c$ of the blade outer portion 260 may be greater than the maximum camber position $\ell_c$ of the blade inner portion 250 by about 10%.

For example, the maximum camber position $\ell_c$ of the blade outer portion 260 may be a position 55 to 65% from the leading edge 223 toward the trailing edge 224 based on the length of the cord $C_2$. In contrast, the maximum camber position $\ell_c$ of the blade inner portion 250 may be a position 45 to 55% from the leading edge 223 to the trailing edge 224 based on the length of the cord $C_2$.

A ratio of the maximum camber amount $C_3$ of the blade outer portion 260 may be greater than that of the maximum camber amount $C_3$ of the blade inner portion 250 by about 0.5%. The ratio of the maximum camber amount $C_3$ may be understood as the ratio of the maximum camber amount $C_3$ to the length of the code $C_2$.

For example, the ratio of the maximum camber amount $C_3$ of the blade outer portion 260 may be in a range of 8 to 10%. In contrast, the ratio of the maximum camber amount $C_3$ of the blade inner portion 250 may be in a range of 7.5 to 9.5%.

The solidity $S_o$ of the blade outer portion 260 may be greater than the solidity $S_o$ of the blade inner portion 250 by about 0.05. For example, the solidity $S_o$ of the blade outer portion 260 may be 0.80 to 0.90. In contrast, the solidity of the blade inner portion 260 may be 0.75 to 0.85.

Figure 9:
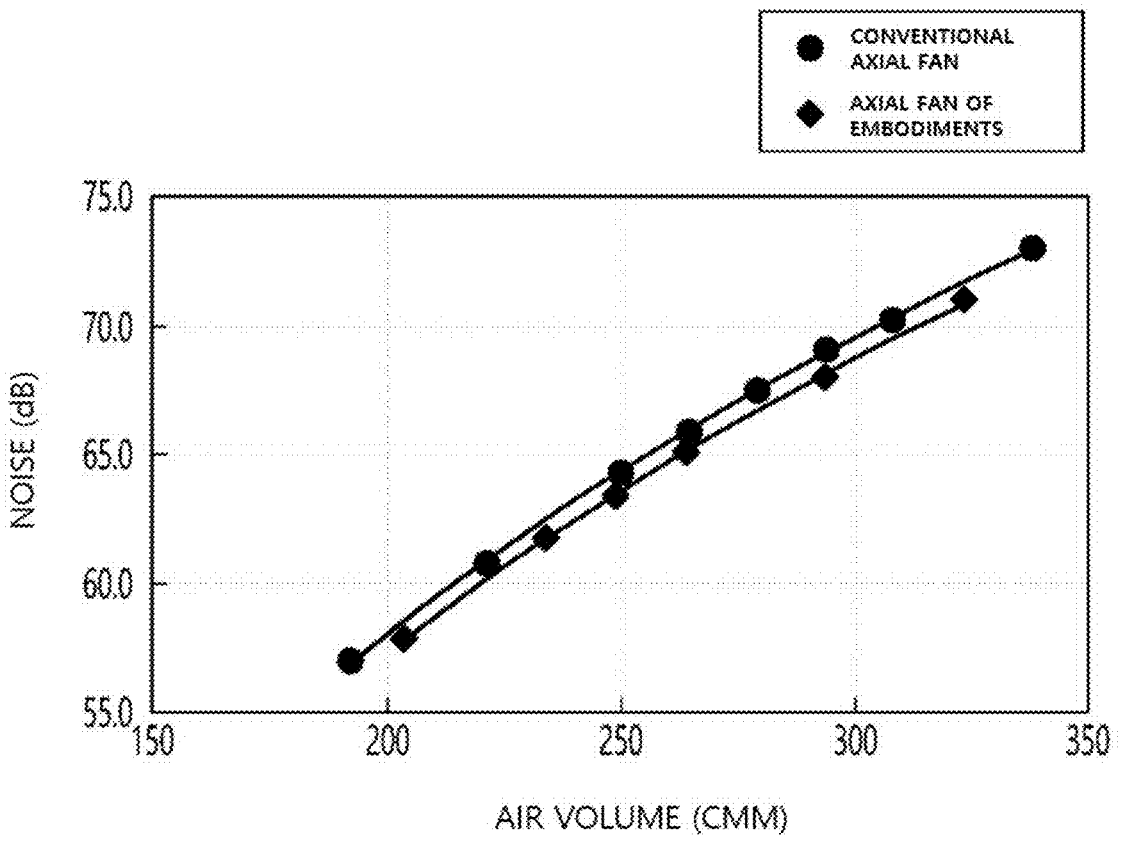
FIGS. 9 and 10 are experimental graphs showing performance improvement in noise and power consumption of an axial fan according to an embodiment.
Figure 10:
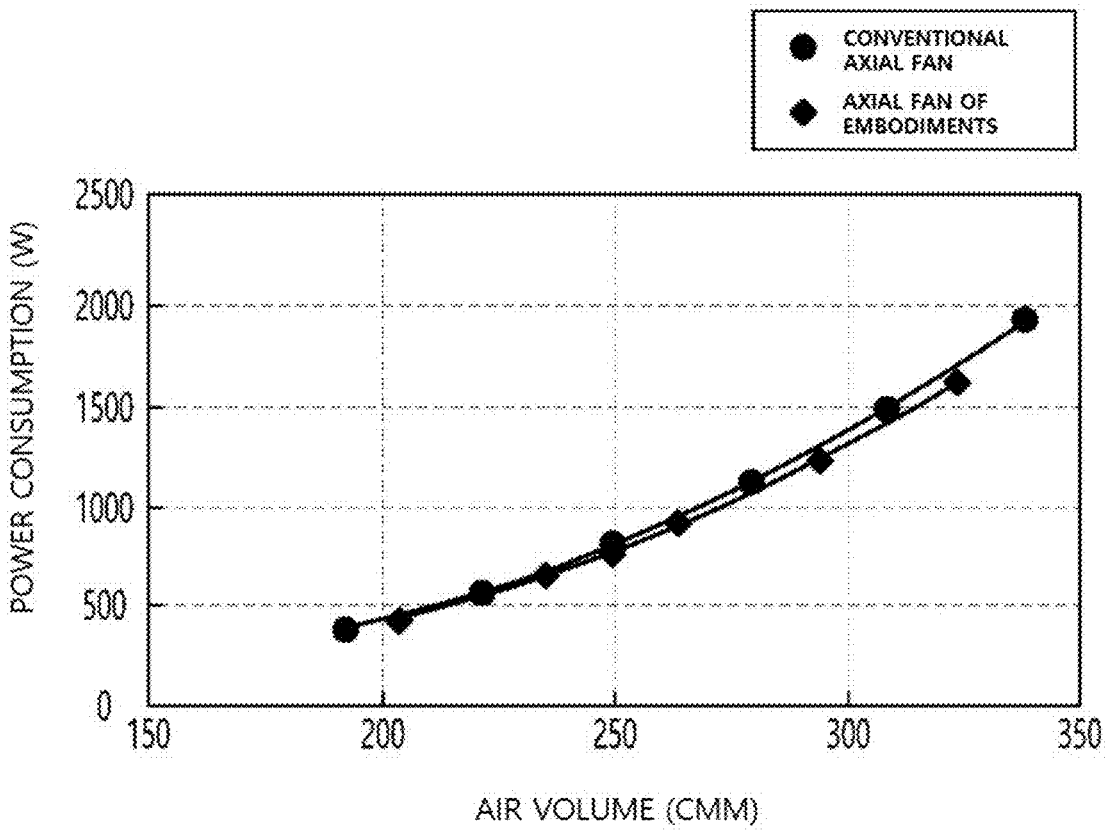

FIGS. 9 and 10 are experimental graphs showing performance improvement in noise and power consumption of an axial fan according to an embodiment. A conventional axial fan does not include the blade inner portion, the blade outer portion, and the blade connector according to embodiments, and extends from a hub to a tip of a blade with a set curvature without being bent.

FIG. 9 shows a result of experimentally measuring a magnitude of noise generated according to air volume with respect to the conventional axial fan and the axial fan according to embodiments disclosed herein. It can be seen that, in a predetermined air volume range (200 CMM to 300 CMM) in the outdoor unit of the air conditioner, the magnitude of noise of the axial fan according to embodiments is less than that of noise in the conventional axial fan.

FIG. 10 shows a result of experimentally measuring a magnitude of power consumption generated according to the air volume with respect to the conventional axial fan and the axial fan according to embodiments disclosed herein. It can be seen that, in a predetermined air volume range (200 CMM to 300 CMM) in the outdoor unit of the air conditioner, power consumed in the axial fan according to embodiments is less than power consumed in the conventional axial fan.

According to embodiments disclosed herein, in consideration of the phenomenon that a difference in flow rate occurs in the radial direction based on the blade of the axial fan and tip leakage flow occurs due to a gap with an orifice of the outdoor unit in the blade tip, as the blade including the blade inner portion, the blade connector, and the blade outer portion may be designed, it is possible to improve flow performance of the fan and to reduce noise.

According to embodiments disclosed herein, it is possible to reduce noise generated by the axial fan and to improve air volume performance, by connecting a blade inner portion and a blade outer portion in a curved surface through a blade connector in a radial direction. Further, according to embodiments disclosed herein, it is possible to differently form shapes of a blade inner portion and a blade outer portion in a radial direction in consideration of the fact that a flow rate of air flowing from a hub of the axial fan to a tip of a blade in a radial direction is differently formed. Therefore, it is possible to prevent tip leakage flow and to reduce noise.

According to embodiments disclosed herein, it is possible to form a relatively large area of a blade outer portion for generating a relatively large air volume, thereby generating a large air volume. Also, according to embodiments disclosed herein, it is possible to make a maximum camber position closer to a rear end than a front end of a blade based on a length of a cord in order to improve blowing ability at the blade outer portion.

According to embodiments disclosed herein, it is possible to obtain a noise attenuation effect, by configuring a blade outer portion to have a phase difference from a blade inner portion in a circumferential direction. Additionally, according to embodiments disclosed herein, it is possible to easily generate a pressure difference between both surfaces of a blade, by bending a blade outer portion toward a blade inner portion at a front end of the blade in a suction surface direction and bending the blade outer portion toward the blade inner portion at a rear end of the blade in a pressure surface direction.

Embodiments disclosed herein provide an axial fan capable of reducing noise generated by the axial fan and improving air volume performance, by connecting a blade inner portion and a blade outer portion in a curved surface through a blade connector in a radial direction. Embodiments disclosed herein further provide an axial fan capable of differently forming shapes of a blade inner portion and a blade outer portion in a radial direction in consideration of the fact that a flow rate of air flowing from a hub of the axial fan to a tip of a blade in a radial direction is differently formed. Embodiments disclosed herein furthermore provide an axial fan capable of forming a relatively large area of a blade outer portion for generating a relatively large air volume.

Embodiments disclosed herein provide an axial fan capable of making a maximum camber position closer to a rear end than a front end of a blade based on the length of a cord in order to improve blowing ability at the blade outer portion. Embodiments disclosed herein also provide an axial fan capable of capable of obtaining a noise attenuation effect, by configuring a blade outer portion to have a phase difference from a blade inner portion in a circumferential direction.

Additionally, embodiments disclosed herein provide an axial fan capable of easily generating a pressure difference between both surfaces of a blade, by bending a blade outer portion toward a blade inner portion at a front end of the blade in a suction surface direction and bending the blade outer portion toward the blade inner portion at a rear end of the blade in a pressure surface direction.

An axial fan according to embodiments disclosed herein may include a blade connected to a hub. The blade may include a blade inner portion, a blade outer portion provided outside of the blade inner portion in a radial direction, and a blade connector that connects the blade inner portion and the blade outer portion in a curved surface, thereby improving noise and increasing an air volume.

An area of the blade outer portion may be greater than an area of the blade inner portion. An area of the blade inner portion may be greater than an area of the blade connector.

A first connection line connecting a center of the axial fan and an outermost portion (based on a radial direction) of a front end of the blade inner portion and a second connection line connecting the center of the axial and an innermost portion (based on the radial direction) of a front end of the blade outer portion may not coincide. The first connection line and the second connection line may have a phase difference in a circumferential direction. The phase difference may have a value greater than 0° and equal to or less than 4°.

Based on the radial direction of the blade, the blade may be bent or curved at least twice. At the leading edge of the blade, the blade may be bent in a first direction at a point at which the blade inner portion and the blade connector are connected and may be bent in a second direction at a point at which the blade connector and the blade outer portion are connected. The first direction and the second direction may be different. The first and second directions may be opposite to each other.

The first direction may be a direction from a pressure surface of the blade toward a suction surface. The second direction may be a direction from the suction surface of the blade toward the pressure surface.

At the trailing edge of the blade, the blade may be bent in a third direction at a point at which the blade inner portion and the blade connector are connected and may be bent in a fourth direction at a point at which the blade connector and the blade outer portion are connected. The third direction and the fourth direction may be different. The third and fourth directions may be opposite to each other.

The third direction may be a direction from a suction surface of the blade toward a pressure surface. The fourth direction may be a direction from the pressure surface of the blade toward the suction surface.

A maximum camber position of the blade outer portion may be closer to the rear end than the front end of the blade.

An axial fan provided in an outdoor unit of an air conditioner according to embodiments disclosed herein may include a hub coupled with a rotational shaft and a plurality of blades provided outside the hub in a circumferential direction and including a hub connector coupled to an outer circumferential surface of the hub and a tip forming an outermost end in a radial direction. The blade may include a blade inner portion forming the hub connector, a blade outer portion forming the tip, and a blade connector connecting the blade inner portion and the blade inner portion and forming an inner end bent from the blade inner portion in one direction and an outer end bent toward the blade outer portion in another direction.

The blade may include a leading edge forming a front end and a trailing edge forming a rear end, with respect to a rotational direction of the blade, and a direction in which the blade connector extends from the leading edge of the blade may be different from a direction in which the blade connector extends from the trailing edge of the blade. At the leading edge of the blade, the blade may be bent in a first direction at a point at which the blade inner portion and the blade connector are connected and may be bent in a second direction at a point at which the blade connector and the blade outer portion are connected. The first direction may be opposite to the second direction.

The first direction may be a direction from a pressure surface of the blade toward a suction surface of the blade. The second direction may be a direction from the suction surface of the blade toward the pressure surface of the blade.

At the trailing edge of the blade, the blade may be bent in a third direction at a point at which the blade inner portion and the blade connector are connected and may be bent in a fourth direction at a point at which the blade connector and the blade outer portion are connected. The third direction may be opposite to the fourth direction.

The third direction may be a direction from a suction surface of the blade toward a pressure surface of the blade. The fourth direction may be a direction from the pressure surface of the blade toward the suction surface of the blade.

The blade connector and the blade outer portion may have a phase difference in the circumferential direction. When a first connection line connecting a center of the hub and a radially outermost portion of the leading edge of the blade inner portion is defined and a second connection line connecting the center of the hub and a radially innermost portion of the leading edge of the blade outer portion is defined, the first connection line $\ell_1$ and the second connection line $\ell_2$ may not coincide.

The first connection line $\ell_1$ and the second connection line $\ell_2$ may have a phase difference in the circumferential direction. The phase difference may have a value greater than 0° and equal to or less than 4°.

The blade connector may be defined as a Bezier curve. The blade connector may be in a range of a dimensionless radius from 0.3 to 0.4, the blade inner portion may be located in a region having a dimensionless radius less than 0.3, and the blade outer portion may be located in a region having a dimensionless radius greater than 0.4.

The blade may be configured such that a maximum camber position $\ell_c$ of the blade outer portion is closer to the trailing edge than the leading edge. Based on the leading edge of the blade, the maximum camber position $\ell_c$ of the blade outer portion may be greater than a maximum camber position $\ell_c$ of the blade inner portion 250. A ratio of a maximum camber amount $C_3$ of the blade outer portion may be greater than that of a maximum camber amount $C_3$ of the blade inner portion.

Solidity $S_o$ of the blade outer portion may be greater than solidity $S_o$ of the blade inner portion.

According to embodiments disclosed herein, an axial fan is provided in an outer unit of an air conditioner that may include a hub and a blade including a hub connector coupled to an outer circumferential surface of the hub and a tip forming an outermost end in a radial direction. The blade may include a blade inner portion forming the hub connector, a blade outer portion forming the tip, and a blade connector connecting the blade inner portion and the blade outer portion and forming an inner end bent from the blade inner portion and an outer end bent toward the blade outer portion.

The blade inner portion, the blade connector and the blade outer portion may extend from the hub connector toward the tip, and a cross-sectional area of the blade inner portion may be less than that of the blade outer portion. The blade connector may extend from the blade inner portion in an outer radial direction, and a cross-sectional area of the blade connector may be less than that of the blade inner portion.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An axial fan for an outdoor unit of an air conditioner, the axial fan comprising:

a hub configured to be coupled with a rotational shaft; and a plurality of blades provided at an outside of the hub in a circumferential direction and including a hub connector coupled to an outer circumferential surface of the hub and a tip that forms an outermost end in a radial direction, wherein at least one of the plurality of blades comprises:

a blade inner portion forming the hub connector;

a blade outer portion forming the tip; and a blade connector that connects the blade inner portion and the blade outer portion and forming an inner end bent from the blade inner portion and an outer end bent toward the blade outer portion, wherein a direction in which the inner end is bent from the blade inner portion is different from a direction in which the outer end is bent toward the blade outer portion, wherein the blade connector is defined as a Bezier curve, and wherein the blade connector is in a range of a dimensionless radius from 0.3 to 0.4, the blade inner portion is located in a region having a dimensionless radius less than 0.3, and the blade outer portion is located in a region having a dimensionless radius greater than 0.4.

2. The axial fan of claim 1, wherein the at least one of the plurality of blades comprises a leading edge forming a front end and a trailing edge forming a rear end, with respect to a rotational direction of the at least one of the plurality of blades, and wherein a direction in which the blade connector extends from the leading edge of the at least one of the plurality of blades is different from a direction in which the blade connector extends from the trailing edge of the at least one of the plurality of blades.

3. The axial fan of claim 2, wherein, at the leading edge of the at least one of the plurality of blades, the at least one of the plurality of blades is bent in a first direction at a first point at which the blade inner portion and the blade connector are connected and is bent in a second direction at a second point at which the blade connector and the blade outer portion are connected.

4. The axial fan of claim 3, wherein the first direction is opposite to the second direction.

5. The axial fan of claim 3, wherein the first direction is a direction from a pressure surface of the at least one of the plurality of blades toward a suction surface of the at least one of the plurality of blades, and the second direction is a direction from the suction surface of the at least one of the plurality of blades toward the pressure surface of the at least one of the plurality of blades.

6. The axial fan of claim 3, wherein, at the trailing edge of the at least one of the plurality of blades, the at least one of the plurality of blades is bent in a third direction at a third point at which the blade inner portion and the blade connector are connected and is bent in a fourth direction at a fourth point at which the blade connector and the blade outer portion are connected.

7. The axial fan of claim 6, wherein the third direction is opposite to the fourth direction.

8. The axial fan of claim 6, wherein the third direction is a direction from a suction surface of the at least one of the plurality of blades toward a pressure surface of the at least one of the plurality of blades, and the fourth direction is a direction from the pressure surface of the at least one of the plurality of blades toward the suction surface of the at least one of the plurality of blades.

9. The axial fan of claim 2, wherein the at least one of the plurality of blades is configured such that a maximum camber position of the blade outer portion is closer to the trailing edge than the leading edge.

10. The axial fan of claim 9, wherein based on the leading edge of the at least one of the plurality of blades, the maximum camber position of the blade outer portion is greater than a maximum camber position of the blade inner portion.

11. The axial fan of claim 1, wherein the blade connector and the blade outer portion have a phase difference in the circumferential direction.

12. The axial fan of claim 1, wherein a ratio of a maximum camber amount of the blade outer portion is greater than a maximum camber amount of the blade inner portion.

13. The axial fan of claim 1, wherein a solidity of the blade outer portion is greater than a solidity of the blade inner portion.

14. An outdoor unit comprising the axial fan of claim 1.

15. An air conditioner comprising the outdoor unit of claim 14.

16. The axial fan of claim 10, wherein when a first connection line connecting a center of the hub and a radially outermost portion of the leading edge of the blade inner portion is defined and a second connection line connecting the center of the hub and a radially innermost portion of the leading edge of the blade outer portion is defined, the first connection line and the second connection line do not coincide.

17. The axial fan of claim 16, wherein the first connection line and the second connection line have a phase difference in the circumferential direction.

18. The axial fan of claim 17, wherein the phase difference is greater than 0° and equal to or less than 4°.

19. An axial fan for an outdoor unit of an air conditioner, the axial fan comprising:

a hub configured to be coupled with a rotational shaft; and a plurality of blades provided at an outside of the hub in a circumferential direction and including a hub connector coupled to an outer circumferential surface of the hub and a tip that forms an outermost end in a radial direction, wherein at least one of the plurality of blades comprises:

a blade inner portion forming the hub connector;

a blade outer portion forming the tip; and a blade connector that connects the blade inner portion and the blade outer portion and forming an inner end bent from the blade inner portion and an outer end bent toward the blade outer portion, wherein a direction in which the inner end is bent from the blade inner portion is different from a direction in which the outer end is bent toward the blade outer portion, wherein the blade connector and the blade outer portion have a phase difference in the circumferential direction, wherein when a first connection line connecting a center of the hub and a radially outermost portion of a leading edge of the blade inner portion is defined and a second connection line connecting the center of the hub and a radially innermost portion of the leading edge of the blade outer portion is defined, the first connection line and the second connection line do not coincide, wherein the first connection line and the second connection line have a phase difference in the circumferential direction, and wherein the phase difference is greater than 0° and equal to or less than 4°.

* * * * *